US012448885B2

(12) United States Patent
Wang et al.

(10) Patent No.: US 12,448,885 B2
(45) Date of Patent: Oct. 21, 2025

(54) MUD PRESSURE WAVE SIGNAL MODULATION APPARATUS AND METHOD

(71) Applicants: China National Petroleum Corporation, Beijing (CN); CNPC Engineering Technology R&D Company Limited, Beijing (CN)

(72) Inventors: Jiajin Wang, Beijing (CN); Weimin Mao, Beijing (CN); Weiping Ai, Beijing (CN); Yifeng Fan, Beijing (CN); Xiurong Dou, Beijing (CN); Hengtian Jia, Beijing (CN); Peng Wang, Beijing (CN); Zhigang Wei, Beijing (CN); Lei Wang, Beijing (CN); Xianwei Guo, Beijing (CN)

(73) Assignees: China National Petroleum Corporation, Beijing (CN); CNPC Engineering Technology R&D Company Limited, Beijing (CN)

( * ) Notice: Subject to any disclaimer, the term of this patent is extended or adjusted under 35 U.S.C. 154(b) by 0 days.

(21) Appl. No.: 18/566,144

(22) PCT Filed: Dec. 6, 2022

(86) PCT No.: PCT/CN2022/136741
§ 371 (c)(1),
(2) Date: Dec. 1, 2023

(87) PCT Pub. No.: WO2023/124814
PCT Pub. Date: Jul. 6, 2023

(65) Prior Publication Data

US 2024/0247586 A1 Jul. 25, 2024

(30) Foreign Application Priority Data

Dec. 30, 2021 (CN) ..... 202111655444.5

(51) Int. Cl.
*E21B 47/20* (2012.01)
*E21B 4/04* (2006.01)
*E21B 44/00* (2006.01)

(52) U.S. Cl.
CPC ..... *E21B 47/20* (2020.05); *E21B 4/04* (2013.01); *E21B 44/005* (2013.01)

(58) Field of Classification Search
CPC ..... E21B 47/12; E21B 47/14; E21B 47/18; E21B 47/20; E21B 47/24; E21B 47/26; E21B 44/005; E21B 4/04
See application file for complete search history.

(56) References Cited

U.S. PATENT DOCUMENTS 5,215,152 A * 6/1993 Duckworth ..... E21B 47/18 175/48
7,280,432 B2 10/2007 Hahn et al.
(Continued)

FOREIGN PATENT DOCUMENTS

CN 103015989 B 7/2015
CN 205265575 U 5/2016
(Continued)

OTHER PUBLICATIONS

Chinese Search Report for Application No. 202111655444.5, dated Sep. 2, 2022 (11 pages, including translation).
(Continued)

*Primary Examiner* — Franklin D Balseca
(74) *Attorney, Agent, or Firm* — Michael Best & Friedrich LLP

(57) ABSTRACT

The present disclosure discloses a mud pressure wave signal modulation apparatus and method, which relate to the technical field of petroleum drilling engineering. The apparatus includes: a motor (5), a valve plate (3), a main control circuit (23), a motor drive control circuit, and a downhole commu-
(Continued)

nication circuit; the valve plate (3) is driven by the motor (5) to be rotated around an axial direction perpendicular to a flow direction of drilling fluid; the motor (5) and the valve plate (3) are disposed in a drilling fluid channel (2), and the drilling fluid channel (2), the motor (5), the valve plate (3), the main control circuit (23), the motor drive control circuit and the downhole communication circuit are disposed in a drill collar.

17 Claims, 8 Drawing Sheets

(56) References Cited

U.S. PATENT DOCUMENTS

| | | | | |
|---|---|---|---|---|
| 9,334,725 | B2 * | 5/2016 | Sitka | E21B 47/24 |
| 10,450,859 | B2 * | 10/2019 | Liu | E21B 47/24 |
| 2013/0162440 | A1 | 6/2013 | Parry et al. | |

FOREIGN PATENT DOCUMENTS

| | | | |
|---|---|---|---|
| CN | 105863622 | A | 8/2016 |
| CN | 205745333 | U | 11/2016 |
| CN | 103696762 | B | 3/2017 |
| CN | 107100614 | A | 8/2017 |
| CN | 105863622 | B | 5/2019 |
| CN | 110707969 | A | 1/2020 |
| CN | 106958442 | B | 1/2021 |
| CN | 113622899 | A | 11/2021 |
| CN | 215213486 | U | 12/2021 |
| CN | 114483013 | A | 5/2022 |
| WO | 2021126276 | A1 | 6/2021 |

OTHER PUBLICATIONS

International Search Report for Application No. PCT/CN2022/136741, dated Feb. 28, 2023 (2 pages).

* cited by examiner

MUD PRESSURE WAVE SIGNAL MODULATION APPARATUS AND METHOD

CROSS-REFERENCE TO RELATED APPLICATIONS

The application is a National Stage of International Application No. PCT/CN2022/136741, filed Dec. 6, 2022, which claims priority to Chinese Patent Application No. 202111655444.5, entitled 'mud pressure wave signal modulation apparatus and method', and filed on Dec. 30, 2021, both of which are hereby incorporated by reference in their entireties.

TECHNICAL FIELD

The present disclosure relates to the technical field of petroleum drilling engineering, and particularly to a mud pressure wave signal modulation apparatus and method.

BACKGROUND

This section is intended to provide the background or context for the embodiments of the present disclosure set forth in the claims. The description here is not admitted to be the prior art just because it is included in this section.

Efficient and safe drilling and precise geosteering are inseparable from real-time downhole measurement information. With the emergence of new instruments for downhole measuring, the measuring parameters are continuously increasing. From the initial measuring instruments for geometric parameter such as angle of inclination, azimuth, toolface, etc. to various measuring instruments for engineering/geological parameter such as bitpressure, torque, bending moment, vibration, rotation speed, pressure, temperature, natural gamma, resistivity, neutron density, hydrogen index, etc., the amount of downhole information to be transmitted is rapidly expanding, but the data transmission rate of the existing conventional telemetry system is low and is difficult to meet the demand of multi-parameter real-time transmission, which has become the bottleneck of the sustainable development of advanced Measurement While Drilling (MWD) technology.

The mud pulse modulation apparatus is one of the key core technologies of high-speed telemetry system. During information transmission, the existing mud pulse modulation apparatus mainly changes the intensity of pressure on a valve plate by rotating the valve plate in drilling fluid, and transmits information through the change in the intensity of pressure. However, the existing mud pulse modulation apparatus is mainly configured with a shear valve or a rotary valve, both of which are perpendicular to the flow direction of the drilling fluid, and the valve plate is rotated around an axial cross-section parallel to the flow direction of the drilling fluid. These two valve plates need to be rotated by a motor to drive a rod parallel to the flow direction of the drilling fluid to be rotated, and the rotation of the rod drives the valve plate to be rotated. Therefore, the response is slow, the torque acting on the valve plate is small, the energy consumption is large, and the electric energy utilization rate is low.

SUMMARY

An embodiment of the present disclosure provides a mud pressure wave signal modulation apparatus to improve the response speed, increase the torque of the motor driving the valve plate to be rotated, reduce the energy consumption and improve the electric energy utilization rate. The apparatus includes a motor, a valve plate, a main control circuit, a motor drive control circuit, and a downhole communication circuit, in which the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in a drilling fluid channel, and the drilling fluid channel, the main control circuit, the motor drive control circuit and the downhole communication circuit are disposed in a drill collar; and the main control circuit is configured to receive downhole Measurement While Drilling (MWD) data sent by the downhole communication circuit, generate a control sequence based on motor data provided by the motor drive control circuit, angle information of the valve plate provided by the downhole communication circuit and a preset working mode, when determining that the downhole MWD data needs to be transmitted to the ground according to a preset program, and send the control sequence to the motor drive control circuit so that the motor drive control circuit controls the motor to work in the preset working mode.

An embodiment of the present disclosure provides a mud pressure wave signal modulation method, which is applied to the main control circuit in the above embodiment, so as to improve the response speed, increase the torque of the motor driving the valve plate to be rotated, reduce the energy consumption and improve the electric energy utilization rate. The method includes:

receiving downhole Measurement While Drilling (MWD) data sent by a downhole communication circuit, and generating a control sequence based on motor data provided by a motor drive control circuit, angle information of a valve plate provided by the downhole communication circuit and a preset working mode, when determining that downhole MWD data needs to be transmitted to the ground according to a preset program; and sending the control sequence to the motor drive control circuit, so that the motor drive control circuit controls a motor to work in the preset working mode.

An embodiment of the present disclosure further provides a computer device, including a memory, a processor and a computer program stored in the memory and runnable on the processor, and when executing the computer program, the processor implements the aforementioned mud pressure wave signal modulation method.

An embodiment of the present disclosure further provides a computer-readable storage medium which stores a computer program, and when executed by a processor, the computer program implements the aforementioned mud pressure wave signal modulation method.

An embodiment of the present disclosure further provides a computer program product including a computer program, and when executed by a processor, the computer program implements the aforementioned mud pressure wave signal modulation method.

The embodiments of the present disclosure provide a mud pressure wave signal modulation apparatus, including a motor, a valve plate, a main control circuit, a motor drive control circuit and a downhole communication circuit, in which the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in a drilling fluid channel, and the drilling fluid channel, the main control circuit, the motor drive control circuit and the downhole communication circuit are disposed in a drill collar; and the main control circuit is configured to receive downhole MWD data sent by the downhole communication circuit, generate a control sequence based on motor data provided by the motor drive control circuit, angle information of the valve plate provided by the downhole communication circuit and a preset working mode, when determining that the downhole MWD data needs to be transmitted to the ground according to the preset program, and send the control sequence to the motor drive control circuit so that the motor drive control circuit controls the motor to work in the preset working mode. In this way, the motor is directly connected to the valve plate, thereby directly driving the valve plate to be rotated, and the valve plate can be driven by the motor to be rotated around the axial direction perpendicular to the flow direction of the drilling fluid, so that the response is quick and the effect is direct, which increases the torque of the motor driving the valve plate to be rotated, reduces the energy consumption, and improves the electric energy utilization rate.

BRIEF DESCRIPTION OF THE DRAWINGS

In order to illustrate the technical solutions in the embodiments of the present disclosure or in the prior art more clearly, the drawings to be used in the description of the embodiments or the prior art will be briefly introduced below. Obviously, the drawings in the following description merely illustrate some embodiments of the present disclosure, and those of ordinary skill in the art may obtain other drawings from these drawings without paying any creative labor. In the drawings.

DETAILED DESCRIPTION

Figure 1:
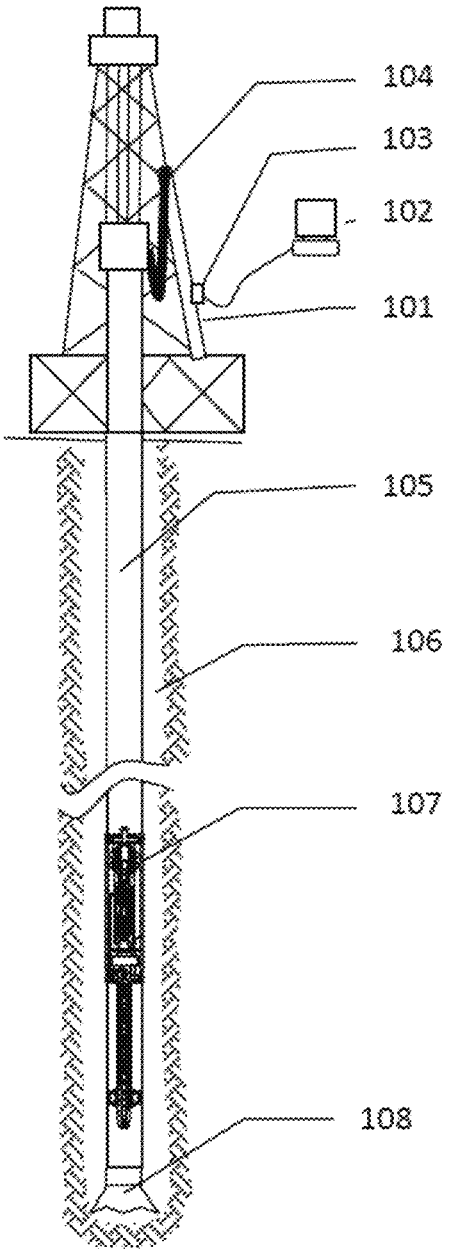
FIG. 1 illustrates a schematic diagram of a wellsite system according to an embodiment of the present disclosure.

In order that the objectives, technical solutions and advantages of the embodiments of the present disclosure are clearer, the embodiments of the present disclosure are further described below in detail with reference to the drawings. Here, the exemplary embodiments of the present disclosure and the descriptions thereof are used to explain the present disclosure, rather than being used as limitations thereto.

Herein the term 'and/or' only describes an associative relationship, indicating that there may be three kinds of relationships. For example, A and/or B may mean that A exists alone, A and B exist simultaneously, and B exists alone. In addition, the term 'at least one' herein mean any one of a plurality of items or any combination of at least two of a plurality of items. For example, 'including at least one of A, B and C' may indicate including any one or more elements selected from a group of A, B, and C.

In the description of the specification, the used terms such as 'include', 'comprise', 'have' and 'contain' are all open terms, which means including but not limited to. The descriptions referring to the terms such as 'an embodiment', 'one specific embodiment', 'some embodiments' or 'for example' mean that a specific feature, structure or characteristic described in conjunction with the embodiment(s) or example(s) is included in at least one embodiment or example of the present disclosure. In the specification, the schematic expressions of the above terms do not necessarily mean the same embodiment or example. Moreover, the described specific features, structures or characteristics may be combined in any one or more embodiments or examples in a suitable manner. The sequence of steps involved in each embodiment is used to schematically illustrate the implementation of the present disclosure, and the sequence of steps is not limited and may be appropriately adjusted as needed.

Researches show that the efficient and safe drilling and accurate geological steering are inseparable from real-time downhole measurement information. With the emergence of new instruments for downhole measuring, the measuring parameters are continuously increasing. From the initial measuring instruments for geometric parameter such as angle of inclination, azimuth, toolface, etc. to various measuring instruments for engineering/geological parameter such as bitpressure, torque, bending moment, vibration, rotation speed, pressure, temperature, natural gamma, resistivity, neutron density, hydrogen index, etc., the amount of downhole information to be transmitted is rapidly expanding, but the data transmission rate of the existing conventional telemetry system is low and is difficult to meet the demand of multi-parameter real-time transmission, which has become the bottleneck of the sustainable development of advanced Measurement While Drilling (MWD) technology. The mud pulse modulation apparatus is one of the key core technologies of high-speed telemetry system. During information transmission, the existing mud pulse modulation apparatus mainly changes the intensity of pressure on a valve plate by rotating the valve plate in drilling fluid, and transmits information through the change in the intensity of pressure. However, the existing mud pulse modulation apparatus is mainly configured with a shear valve or a rotary valve, both of which are perpendicular to the flow direction of the drilling fluid, and the valve plate is rotated around an axial cross-section parallel to the flow direction of the drilling fluid. These two valve plates need to be rotated by a motor to drive a rod parallel to the flow direction of the drilling fluid to be rotated, and the rotation of the rod drives the valve plate to be rotated. Therefore, the response is slow, the torque acting on the valve plate is small, the energy consumption is large, and the electric energy utilization rate is low.

In view of the above researches, an embodiment of the present disclosure provides a mud pressure wave signal modulation apparatus, including a motor, a valve plate, a main control circuit, a motor drive control circuit, a downhole communication circuit and a motor torque output shaft, in which the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in a drilling fluid channel, and the drilling fluid channel, the main control circuit, the motor drive control circuit and the downhole communication circuit are disposed in a drill collar; and the main control circuit is configured to receive downhole MWD data transmitted by the downhole communication circuit, generate a control sequence based on motor data provided by the motor drive control circuit, angle information of the valve plate provided by the downhole communication circuit and a preset working mode, when determining that the downhole MWD data needs to be transmitted to the ground according to a preset program, and send the control sequence to the motor drive control circuit so that the motor drive control circuit controls the motor to work in the preset working mode.

In the embodiment of the present disclosure, the motor is directly connected to the valve plate, thereby directly driving the valve plate to be rotated, and the valve plate can be driven by the motor to be rotated around the axial direction perpendicular to the flow direction of the drilling fluid, so that the response is quick and the effect is direct, which increases the torque of the motor driving the valve plate to be rotated, reduces the energy consumption, and improves the electric energy utilization rate.

The mud pressure wave signal modulation apparatus is described in detail below.

The mud pressure wave signal modulation apparatus described in the embodiment of the present disclosure may be configured in the wellsite systems of various petroleum drilling scenarios. FIG. 1 illustrates a schematic diagram of a wellsite system according to the embodiment of the present disclosure, to which the mud pressure wave signal modulation apparatus according to the embodiment of the present disclosure can be applied. As illustrated in FIG. 1, the wellsite system includes, for example, a riser 101, a ground system 102, a pressure sensor 103, a rotary hose 104, a mud channel 105 in a drill string, an annular 106 between the drill string and a borehole wall, a mud pressure wave signal modulation apparatus 107 according to the embodiment of the present disclosure, and a drill bit 108 for rock disintegration.

Here, FIG. 1 is only one possible application scenario of the mud pressure wave signal modulation apparatus according to the embodiment of the present disclosure, rather than limiting that the mud pressure wave signal modulation apparatus according to the embodiment of the present disclosure can only be applied in this scenario.

The mud pressure wave signal modulation apparatus according to the embodiment of the present disclosure includes a motor, a valve plate, a main control circuit 23, a motor drive control circuit, a downhole communication circuit and a motor torque output shaft; the motor and the valve plate are disposed in a drilling fluid channel, and the drilling fluid channel, the main control circuit, the motor drive control circuit and the downhole communication circuit are disposed in a drill collar; the valve plate is driven by the motor to be rotated around an axial direction perpendicular to a flow direction of drilling fluid, and a cross-section for controlling a size of an actual flow channel of the drilling fluid in the drilling fluid channel is formed through the rotation of the valve plate.

Here, the motor for example may be a servo motor, and the main control circuit for example may be composed of DSP, FPGA and various discrete components.

In addition, the valve plate for example includes an arc-shaped valve plate. A cross-section formed by the arc-shaped valve plate blocks the flow of the drilling fluid in the drilling fluid channel when being rotated to a direction perpendicular to the drilling fluid, and the actual flow channel of the drilling fluid in the drilling fluid channel is the largest when the cross-section formed by the arc-shaped valve plate is rotated to a direction parallel to the drilling fluid.

In an embodiment of the present disclosure, the mud pressure wave signal modulation apparatus for example further includes a motor torque output shaft perpendicular to the flow direction of the drilling fluid, and the valve plate is connected to the motor through the motor torque output shaft and is driven by the motor to be rotated around the motor torque output shaft.

Figure 2:
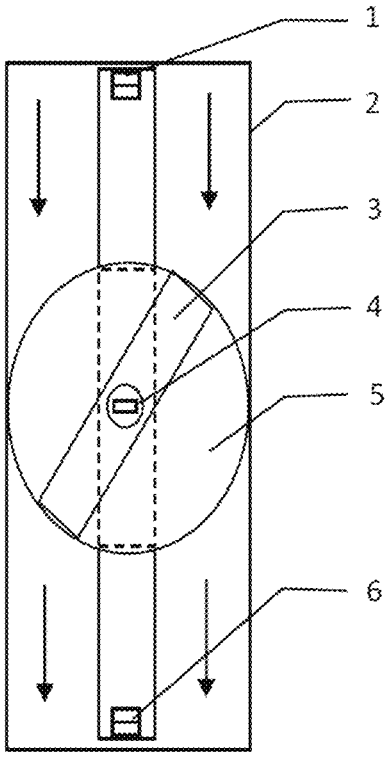
FIG. 2 illustrates a schematic diagram of a connection between a motor and a valve plate of a mud pressure wave signal modulation apparatus according to an embodiment of the present disclosure.

Exemplarily, as illustrated in FIG. 2, which is a schematic diagram of a connection between a motor and a valve plate of a mud pressure wave signal modulation apparatus according to an embodiment of the present disclosure, in which 2 denotes a drilling fluid channel, 3 denotes an arc-shaped valve plate, 5 denotes a motor, 1 and 6 denote connectors which provide channels for a downhole power supply and communication cables, and 4 denotes a motor torque output shaft which is configured to firmly connect the motor 5 and the arc-shaped valve plate 3, and an arrow direction is a flow direction of the drilling fluid, and the motor torque output shaft 4 is perpendicular to the flow direction of the drilling fluid.

Figure 3:
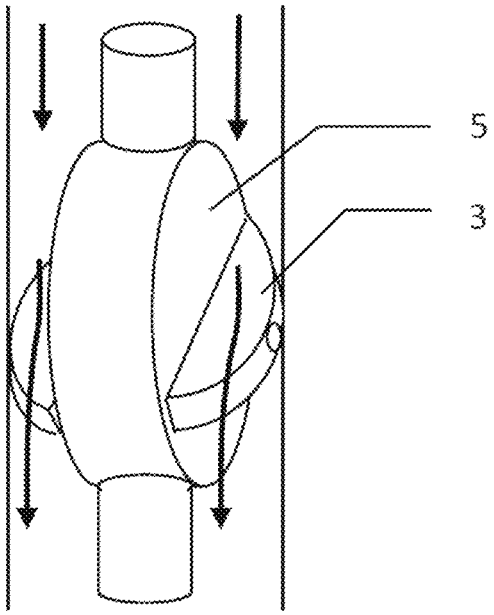
FIG. 3 illustrates a schematic diagram of the connection between the motor and the valve plate in FIG. 2 from another viewing angle.

In order to better illustrate the connection mode and the rotation mode of the motor torque output shaft 4, the motor 5 and the arc-shaped valve plate 3, as illustrated in FIG. 3, which is a schematic diagram of the connection between the motor and the valve plate in FIG. 2 from another viewing angle, 3 denotes the arc-shaped valve plate, 5 denotes the motor and 4 denotes the motor torque output shaft, and the motor 5 drives the arc-shaped valve plate 3 to be rotated through the motor torque output shaft 4, and the arc-shaped valve plate 3 is rotated around the axial direction (the motor torque output shaft 4) perpendicular to the flow direction of the drilling fluid. A cross-section formed by the arc-shaped valve plate can block the flow of the drilling fluid in the drilling fluid channel when being rotated to a direction perpendicular to the drilling fluid, and the actual flow channel of the drilling fluid in the drilling fluid channel is the largest when the cross-section formed by the arc-shaped valve plate is rotated to a direction parallel to the drilling fluid. By adjusting a rotation angle of the valve plate, it is possible to adjust an angle of the cross-section of the valve plate, thereby adjusting the size of the actual flow channel of the drilling fluid in the drilling fluid channel.

Here, FIGS. 2 and 3 only illustrate examples of the motor and the valve plate. The motor in the mud pressure wave signal modulation apparatus according to the embodiment of the present disclosure for example may also be connected to the valve plate through any other smaller device, which is not limited here.

The principles of respective parts in the mud pressure wave signal modulation apparatus are as follows.

The main control circuit receives downhole MWD data sent by the downhole communication circuit, and generates a control sequence based on motor data provided by the motor drive control circuit, angle information of the valve plate provided by the downhole communication circuit and a preset working mode, when determining that the downhole MWD data needs to be transmitted to the ground according to the preset program, and sends the control sequence to the motor drive control circuit so that the motor drive control circuit controls the motor to work in the preset working mode.

Here, the motor data for example includes at least one selected from the group of position information, coil temperature, rotor speed, motor fault code, etc. The MWD data for example includes angle of inclination, azimuth, toolface, etc. The motor data provided by the downhole communication circuit for example may be sent to the main control circuit through the downhole communication circuit.

Specifically, in an embodiment of the present disclosure, the mud pressure wave signal modulation apparatus further includes a data processing and storage circuit. When receiving the downhole MWD data sent by the downhole communication circuit, the main control circuit can determine whether or not the MWD data needs to be sent to the ground according to the preset program; if not, the main control circuit stores the MWD data in the data processing and storage circuit, and if so, the main control circuit fetchs the downhole MWD data from the data processing and storage circuit.

In addition, in an embodiment of the present disclosure, the mud pressure wave signal modulation apparatus further includes a power conversion circuit, which includes a first end connected to the main control circuit and a second end connected to the motor drive control circuit. When the main control circuit generates the control sequence based on the motor data provided by the motor drive control circuit, the angle information of the valve plate provided by the downhole communication circuit and the preset working mode, and sends the control sequence to the motor drive control circuit, so that the motor drive control circuit controls the motor to work in the preset working mode, if the motor drive control circuit is not started, the power conversion circuit is controlled to supply power for the motor drive control circuit. After the power supply, basing on the motor data provided by the motor drive control circuit, the angle information of the valve plate provided by the downhole communication circuit and the preset working mode, the control time sequence is generated and sent to the motor drive control circuit. The power conversion circuit is controlled to stop supplying power to the motor drive control circuit when it is not necessary to continuously transmit the downhole MWD data to the ground.

Figure 4:
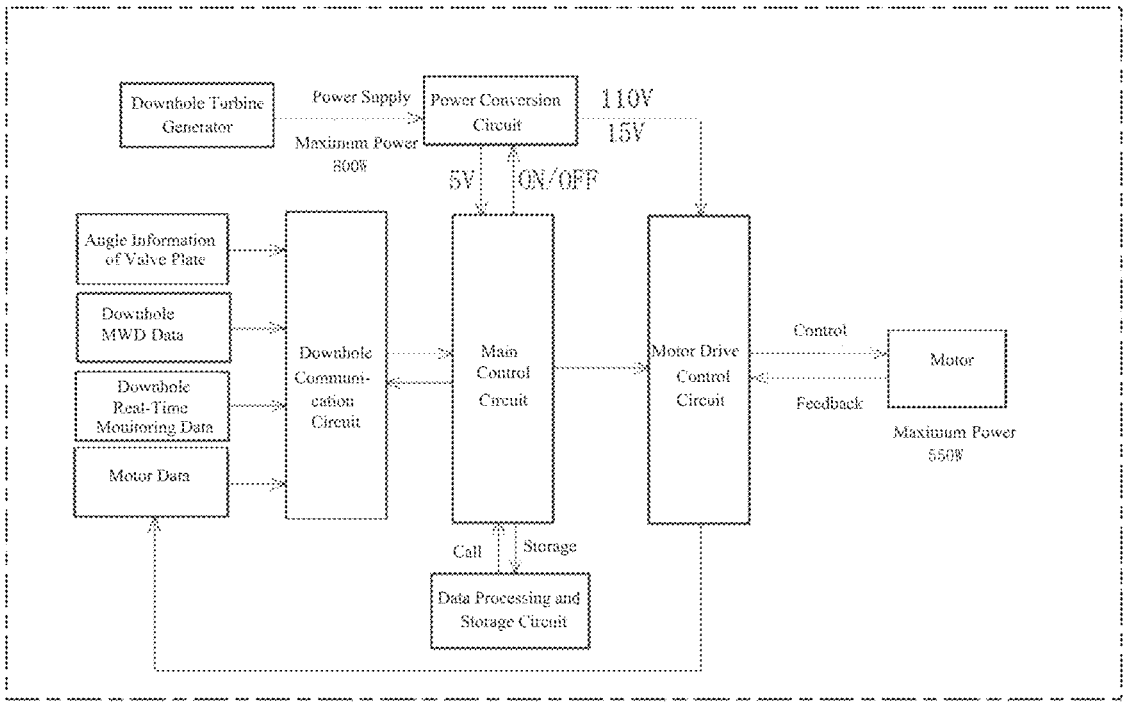
FIG. 4 illustrates a schematic diagram of a communication principle between respective parts of a mud pressure wave signal modulation apparatus according to an embodiment of the present disclosure.

Exemplary, FIG. 4 illustrates a schematic diagram of a communication principle between respective parts of a mud pressure wave signal modulation apparatus according to an embodiment of the present disclosure. During working, a downhole turbine generator supplies power to a downhole power conversion circuit, with maximum power of 800 W. The power conversion circuit converts a voltage provided by the turbine generator into 5V, and then supplies power to the main control circuit. The main control circuit can receive the motor data, the angle information of the valve plate and the MWD data sent by the downhole communication circuit, store the MWD data in a data processing and storage circuit when the MWD data does not need to be sent to the ground, and fetch the MWD data therefrom when the MWD data needs to be sent (e.g., when a ground instruction indicating to send the MWD data is received); determine whether or not the motor drive circuit is started when the MWD data needs to be sent to the ground; if not, control the switch of the power conversion circuit and the motor drive control circuit is turned on, and control the power conversion circuit to provide a voltage of 15V to 110V for the motor drive control circuit; next, generate a control sequence based on the angle information of the valve plate and a preset working mode, and send the control sequence to the motor drive control circuit so that the motor drive control circuit controls the motor to work in the preset working mode.

Here, the preset working mode for example includes: Mode 1: the motor rotates continuously, the valve plate rotates with the motor in a complete circular motion, and a complete circle of rotation is a motor working cycle.

Figure 5:
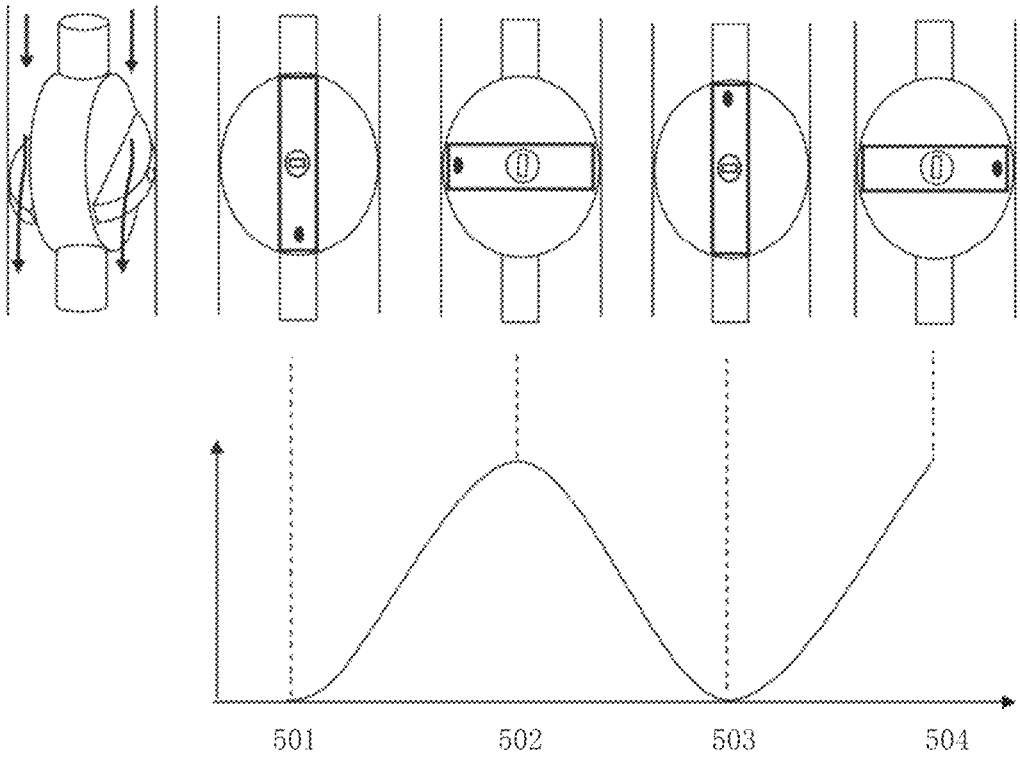
FIG. 5 illustrates a schematic diagram of a valve cycle motion and a mud pulse signal generation mode corresponding to working mode 1 according to an embodiment of the present disclosure.

In this mode, a signal amplitude variation curve generated by the mud pressure wave signal modulation apparatus through the rotation of the valve plate approaches a sine wave, as illustrated in FIG. 5, in which 501 denotes an initial position of the valve plate; when the motor drives the valve plate to move clockwise by 90 to a position 502, the pressure in the drilling fluid channel is the largest, and the formed signal amplitude is also the largest; next, when the motor drives the valve plate to move by 180°, i.e., to a position 503, the signal amplitude returns to zero; when the valve plate moves by 270°, i.e., to a position 504, the signal amplitude is the largest again; and when the valve plate moves by 360°, i.e., back to the initial position, the signal amplitude returns to zero again. During the signa modulation, 501-503 may be regarded as a complete cycle, i.e., half a sine wave is regarded as a complete signal; or, 501-503-501 may be regarded as a complete cycle, i.e., the whole sine wave is regarded as a complete signal. The advantage of selecting 501-503 as a complete cycle is that the modulation time is shortened by half and the modulation efficiency is doubled, but bit errors may be easily caused by noise.

Figure 6:
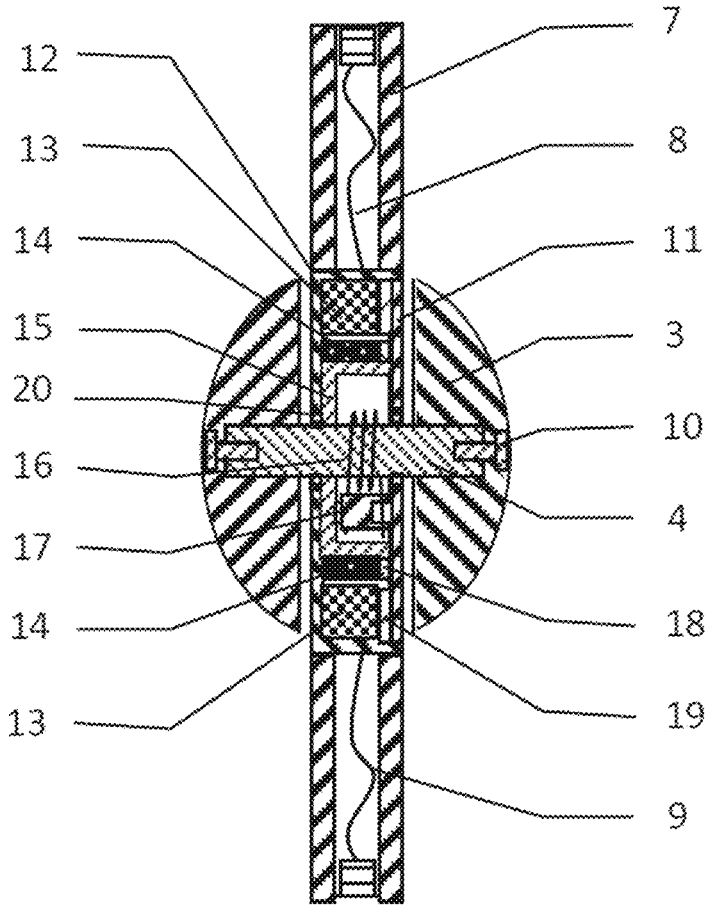
FIG. 6 illustrates a schematic diagram of an axial cross-section of a mud pressure wave signal modulation apparatus according to an embodiment of the present disclosure.
Figure 7:
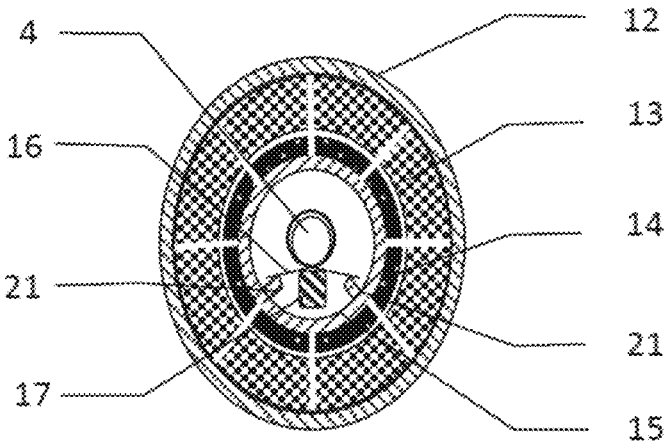
FIG. 7 illustrates a schematic diagram of an axial cross-section of a mud pressure wave signal modulation apparatus according to an embodiment of the present disclosure.

In addition, in another embodiment of the present disclosure, the motor torque output shaft for example is further provided with a torsion spring. FIG. 6 illustrates a schematic diagram of an axial cross-section of a mud pressure wave signal modulation apparatus according to an embodiment of the present disclosure, in which 7 denotes a compressive housing, which is a mechanical carrier of the mud pressure wave signal modulation apparatus and is used as a pressure-bearing and anti-corrosion protection mechanism; 8 and 9 denote power supply and communication cables; 10 denotes an anchor bolt for connecting the motor torque output shaft 4 and the valve plate 3; 11 denotes a sealing end cover for maintaining positive pressure sealing of a motor compartment; 12, 19 denote an out housing of the motor compartment; 13 denotes motor stator coils; 14, 18 denote rotor magnetic poles, and 15 denotes a rotor mechanical skeleton; 16 denotes a torsion spring; 17 denotes a supporting structure; 20 denotes a sealed bearing; and 21 denotes a spring supporting device. FIG. 7 illustrates a schematic diagram of an axial cross-section of a mud pressure wave signal modulation apparatus according to an embodiment of the present disclosure, and the torsion spring 16 includes a first end connected to the motor torque output shaft 4, and a second end connected to the valve plate 3 (not illustrated in the figure). Therefore, the preset working mode for example further includes:

Mode 2: the motor works intermittently; after the motor drives the valve plate to deflect by a first preset angle from an initial position to a first preset direction, the motor stops working, and the valve plate moves in a direction opposite to the first preset direction under the action of the torsion spring; after the valve plate moves to the initial position, the motor continues working and drives the valve plate to deflect by the first preset angle in the direction opposite to the first preset direction, then the motor stops working, and the valve plate moves to the first preset direction under the action of the torsion spring until returning to the initial position, which is a motor working cycle.

Figure 8:
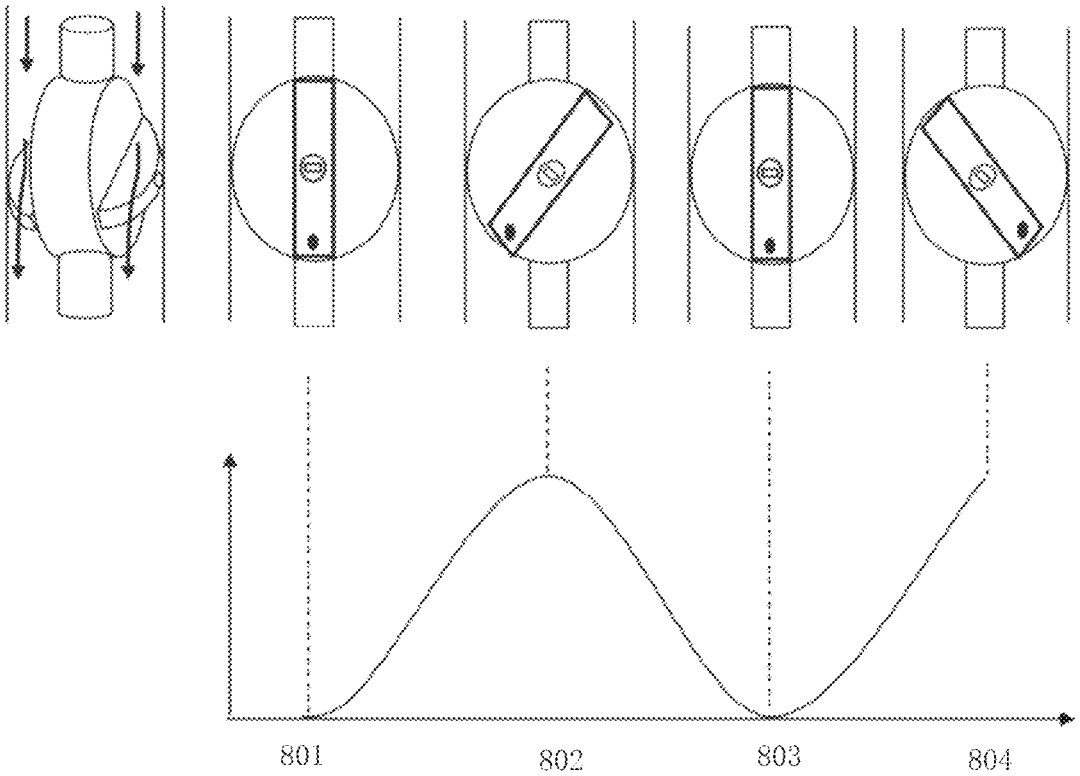
FIG. 8 illustrates a schematic diagram of a valve cycle motion and a mud pulse signal generation mode corresponding to working mode 2 according to an embodiment of the present disclosure.

In this mode, a signal amplitude variation curve generated by the mud pressure wave signal modulation apparatus through the rotation of the valve plate also approaches a sine wave. As illustrated in FIG. 8, an initial position of the valve plate is 801, and when the motor drives the valve plate to move clockwise by one angle from the position 801 to a position 802, the motor stops outputting a torque; when the valve plate bounces counterclockwise to a position 803 under the action of the torsion spring, the motor resumes working and applies a counterclockwise torque; when the valve plate is driven to move counterclockwise to a position 804, the motor stops working, the valve plate bounces clockwise again to the initial position 801 under the action of the torsion spring, and the signal amplitude returns to zero again. Similarly, in this embodiment, 801-803 may be regarded as a complete cycle, or 801-803-801 may be regarded as a complete cycle. The advantage of the former is still that the modulation time is shortened by half and the modulation efficiency is doubled, but bit errors are easily caused by noise.

Mode 3: the motor works intermittently; after the motor drives the valve plate to deflect by a second preset angle from an initial position to a second preset direction, the motor stops working, and the valve plate swings back and forth in the second preset direction and a direction opposite thereto under the action of the torsion spring until finally stopping at the initial position, which is a motor working cycle.

In this mode, through the rotation of the valve plate, the mud pressure wave signal modulation apparatus generates a series of oscillating pressure wave signals with gradually attenuated amplitude.

The above three working modes may satisfy different application scenarios respectively. In mode 2, the valve plate does not need to rotate by 360° and only needs to swing by a small angle (e.g., between 12.5° and 25°) to complete the signal modulation, which takes the least time to complete a working cycle. However, due to the small swing amplitude of the valve plate, the amplitude change of the pulse signal is smaller than that in Mode 1, and the requirement of ground decoding is higher. In Mode 3, the modulation cycle of a pulse signal is composed of a series of oscillation waveforms with gradually attenuated amplitude, and working cycle is the longest, but at the same time, the signal is most unlikely to be misjudged or misrecognized, and the reliability is the highest among the three modes. Therefore, during applications, Mode 2 may be considered for shallow shafts to improve the downhole information transmission rate, and Mode 1 or Mode 3 may be adopted for deep and ultra-deep wells to effectively ensure the signal transmission quality.

In addition, the preset working mode of the motor of the mud pressure wave signal modulation apparatus may be changed based on the instruction from ground. In an embodiment of the present disclosure, when receiving the instruction indicating to switch the working mode sent from ground, the main control circuit generates a control sequence based on the motor data provided by the motor drive control circuit, the angle information of the valve plate provided by the downhole communication circuit and switched working mode, and send the control sequence to the motor drive control circuit so that the motor drive control circuit controls the motor to work in switched working mode.

Figure 9:
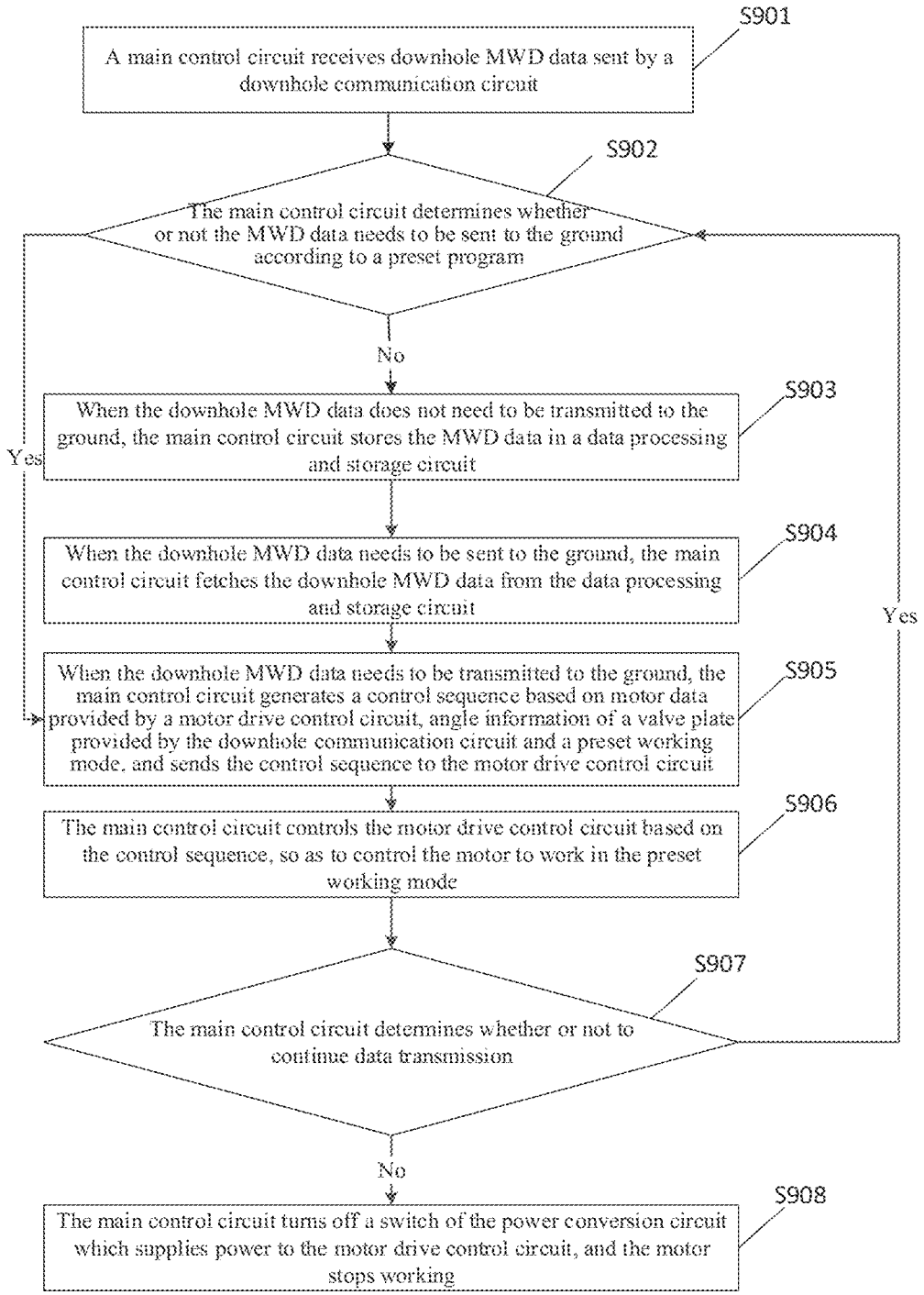
FIG. 9 illustrates a schematic diagram of a working principle of a mud pressure wave signal modulation apparatus which communicates based on the communication principle illustrated in FIG. 4 according to an embodiment of the present disclosure.

In order to better understand the working principle of respective parts of the mud pressure wave signal modulation apparatus, an example will be given below. FIG. 9 illustrates a schematic diagram of a working principle of a mud pressure wave signal modulation apparatus which communicates based on the communication principle illustrated in FIG. 4 according to an embodiment of the present disclosure including:

- S901: a main control circuit receives downhole MWD data sent by a downhole communication circuit;
- S902: the main control circuit determines whether or not the MWD data needs to be sent to the ground according to a preset program; if so, turning to S905, or if not, turning to S903;
- S903: when the downhole MWD data does not need to be transmitted to the ground, the main control circuit stores the MWD data in a data processing and storage circuit;
- S904: when the downhole MWD data needs to be sent to the ground, the main control circuit fetches the downhole MWD data from the data processing and storage circuit;
- S905: when the downhole MWD data needs to be transmitted to the ground, the main control circuit generates a control sequence based on motor data provided by a motor drive control circuit, angle information of a valve plate provided by the downhole communication circuit and a preset working mode, and sends the control sequence to the motor drive control circuit;
- S906: the main control circuit controls the motor drive control circuit based on the control sequence, so as to control the motor to work in the preset working mode;
- S907: the main control circuit determines whether or not to continue data transmission, and if so, returning to S902, or if not, turning to S908;
- S908: the main control circuit turns off a switch of the power conversion circuit which supplies power to the motor drive control circuit, and the motor stops working.

In addition, in an embodiment of the present disclosure, as illustrated in FIG. 4, the downhole communication circuit may further send real-time monitoring data to the main control circuit. The main control circuit receives the downhole real-time monitoring data sent by the downhole communication circuit, and when receiving a ground instruction indicating to send the downhole real-time monitoring data to the ground, generates a control sequence based on the motor data provided by the motor drive control circuit, the angle information of the valve plate provided by the downhole communication circuit and the preset working mode, and sends the control sequence to the motor drive control circuit so that the motor drive control circuit controls the motor to work in the preset working mode.

An embodiment of the present disclosure further provides a mud pressure wave signal modulation method applied to the main control circuit according to the embodiment of the present disclosure, as described in the following embodiment. Since the principle of the method to solve the problem is similar to that of the mud pressure wave signal modulation apparatus, the implementation of the method can refer to the implementation of the mud pressure wave signal modulation apparatus, and the repeated content will be omitted.

Figure 10:
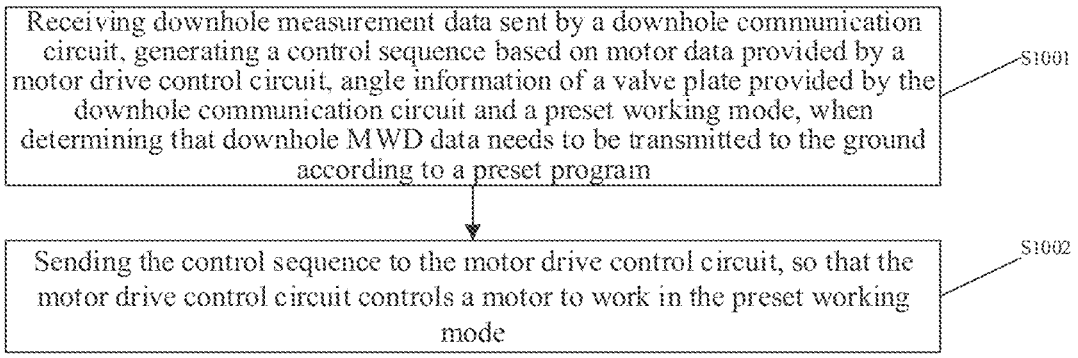
FIG. 10 illustrates a flowchart of a mud pressure wave signal modulation method according to an embodiment of the present disclosure.

FIG. 10 illustrates a flowchart of a mud pressure wave signal modulation method according to an embodiment of the present disclosure, including:

S1001: receiving downhole measurement data sent by a downhole communication circuit, generating a control sequence based on motor data provided by a motor drive control circuit, angle information of a valve plate provided by the downhole communication circuit and a preset working mode, when determining that downhole MWD data needs to be transmitted to the ground according to a preset program; and

S1002: sending the control sequence to the motor drive control circuit, so that the motor drive control circuit controls a motor to work in the preset working mode.

In a possible embodiment, the mud pressure wave signal modulation apparatus further includes a motor torque output shaft provided with a torsion spring. When a first end of the torsion spring is connected to the motor torque output shaft, and a second end thereof is connected to the valve plate, the preset working mode includes any one of the following mode1, mode2 and mode3: the mode 1: the motor rotates continuously, the valve plate rotates with the motor in a complete circular motion, and a complete circle of rotation is a motor working cycle; the mode 2: the motor works intermittently; after the motor drives the valve plate to deflect by a first preset angle from an initial position to a first preset direction, the motor stops working, and the valve plate moves in a direction opposite to the first preset direction under the action of the torsion spring; after the valve plate moves to the initial position, the motor continues working and drives the valve plate to deflect by the first preset angle in the direction opposite to the first preset direction, then the motor stops working, and the valve plate moves to the first preset direction under the action of the torsion spring until returning to the initial position, which is a motor working cycle; and the mode 3: the motor works intermittently; after the motor drives the valve plate to deflect by a second preset angle from an initial position to a second preset direction, the motor stops working, and the valve plate swings back and forth in the second preset direction and a direction opposite thereto under the action of the torsion spring until finally stopping at the initial position, which is a motor working cycle.

In a possible embodiment, the method further includes: when receiving the downhole MWD data sent by the downhole communication circuit, and determining that the downhole MWD data does not need to be transmitted to the ground according to the preset program, storing the downhole MWD data in the data processing and storage circuit, and fetching the downhole MWD data therefrom when the downhole MWD data needs to be sent to the ground.

In a possible embodiment, the method further includes: receiving downhole real-time monitoring data sent by the downhole communication circuit; and when receiving a ground instruction indicating to transmit the downhole real-time monitoring data to the ground, generating a control sequence based on the motor data provided by the motor drive control circuit, the angle information of the valve plate provided by the downhole communication circuit and the preset working mode, and sending the control sequence to the motor drive control circuit so that the motor drive control circuit controls the motor to work in the preset working mode.

In a possible embodiment, the method further includes: when receiving the downhole MWD data sent by the downhole communication circuit and determining that the downhole MWD data needs to be transmitted to the ground according to the preset program, if the motor drive control circuit is not started, controlling the power conversion circuit to supply power for the motor drive control circuit; and if the downhole MWD data no longer needs to be transmitted to the ground, controlling the power conversion circuit to stop supplying power to the motor drive control circuit.

In a possible embodiment, the motor data includes at least one selected from the group of position information, coil temperature, rotor speed, and motor fault code.

In a possible embodiment, the method further includes: when receiving a ground instruction indicating to switch the working mode, generating a control sequence based on the motor data provided by the motor drive control circuit, the angle information of the valve plate provided by the downhole communication circuit and switched working mode, and sending the control sequence to the motor drive control circuit so that the motor drive control circuit controls the motor to work in switched working mode.

An embodiment of the present disclosure further provides a computer device, including a memory, a processor and a computer program stored in the memory and runnable on the processor, and when executing the computer program, the processor implements the aforementioned mud pressure wave signal modulation method.

An embodiment of the present disclosure further provides a computer-readable storage medium which stores a computer program, and when executed by a processor, the computer program implements the aforementioned mud pressure wave signal modulation method.

An embodiment of the present disclosure further provides a computer program product including a computer program, and when executed by a processor, the computer program implements the aforementioned mud pressure wave signal modulation method.

The embodiments of the present disclosure provide a mud pressure wave signal modulation apparatus, including a motor, a valve plate, a main control circuit, a motor drive control circuit and a downhole communication circuit in which the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in a drilling fluid channel, and the drilling fluid channel, the main control circuit, the motor drive control circuit and the downhole communication circuit are disposed in a drill collar; and the main control circuit is configured to receive downhole MWD data sent by the downhole communication circuit, generate a control sequence based on motor data provided by the motor drive control circuit, angle information of the valve plate provided by the downhole communication circuit and a preset working mode, when determining that the downhole MWD data needs to be transmitted to the ground according to the preset program, and send the control sequence to the motor drive control circuit so that the motor drive control circuit controls the motor to work in the preset working mode. In this way, the motor is directly connected to the valve plate, thereby directly driving the valve plate to be rotated, and the valve plate can be driven by the motor to be rotated around the axial direction perpendicular to the flow direction of the drilling fluid, so that the response is quick and the effect is direct, which increases the torque of the motor driving the valve plate to be rotated, reduces the energy consumption, and improves the electric energy utilization rate.

Those skilled in the art should appreciate that any embodiment of the present disclosure may be provided as a method, a system or a computer program product. Therefore, the present disclosure may take the form of a full hardware embodiment, a full software embodiment, or an embodiment combining software and hardware. Moreover, the present disclosure may take the form of a computer program product implemented on one or more computer usable storage mediums (including, but not limited to, a magnetic disc memory, CD-ROM, optical storage, etc.) containing therein computer usable program codes.

The present disclosure is described with reference to a flowchart and/or a block diagram of the method, device (system) and computer program product according to the embodiments of the present disclosure. It should be appreciated that each flow and/or block in the flowchart and/or the block diagram and combinations thereof may be implemented by computer program instructions. These computer program instructions may be provided to a general computer, a dedicated computer, an embedded processing machine or a processor of any other programmable data processing device to produce a machine, so that the instructions executed by the processor of the computer or any other programmable data processing device produce means for realizing the functions specified in one or more flows in the flowchart and/or one or more blocks in the block diagram.

These computer program instructions may also be stored in a computer readable memory capable of guiding a computer or any other programmable data processing device to work in a particular manner, so that the instructions stored in the computer readable memory may produce manufacture articles including an instructing device which realizes the functions specified in one or more flows in the flow diagram and/or one or more blocks in the block diagram.

These computer program instructions may also be loaded into a computer or any other programmable data processing device, so that a series of operational steps can be performed on the computer or any other programmable device to produce a computer-implemented process, and the instructions executed on the computer or any other programmable device provide the steps for realizing the functions specified in one or more flows in the flowchart and/or one or more blocks in the block diagram.

The specific embodiments described above further illustrate the objectives, technical solutions and advantageous effects of the present disclosure in detail. It should be understood that those described above are merely specific embodiments of the present disclosure and are not intended to limit the protection scope of the present disclosure. Any modification, equivalent substitution, improvement, etc. made within the spirit and principle of the present disclosure should fall within the protection scope of the present disclosure.

The invention claimed is:

1. A mud pressure wave signal modulation apparatus, comprising a motor, a valve plate, a main control circuit, a motor drive control circuit, and a downhole communication circuit;

wherein the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in the drilling fluid channel, and the drilling fluid channel, the main control circuit, the motor drive control circuit and the downhole communication circuit are disposed in a drill collar; and the main control circuit is configured to receive downhole Measurement While Drilling data sent by the downhole communication circuit, generate a control sequence based on motor data provided by the motor drive control circuit, angle information of the valve plate provided by the downhole communication circuit and a preset working mode, when determining that the downhole Measurement While Drilling data needs to be transmitted to ground according to a preset program, and send the control sequence to the motor drive control circuit so that the motor drive control circuit controls the motor to work in the preset working mode.

2. The mud pressure wave signal modulation apparatus according to claim 1, wherein the valve plate comprises an arc-shaped valve plate; a cross-section formed by the arc-shaped valve plate blocks a flow of the drilling fluid in the drilling fluid channel when being rotated to a direction perpendicular to the drilling fluid, and the actual flow channel of the drilling fluid in the drilling fluid channel is the largest when the cross-section formed by the arc-shaped valve plate is rotated to a direction parallel to the drilling fluid.

3. The mud pressure wave signal modulation apparatus according to claim 1, further comprising a motor torque output shaft perpendicular to the flow direction of the drilling fluid, and the valve plate is connected to the motor through the motor torque output shaft and is driven by the motor to be rotated around the motor torque output shaft.

4. The mud pressure wave signal modulation apparatus according to claim 3, wherein the motor torque output shaft is further provided with a torsion spring which comprises a first end connected to the motor torque output shaft and a second end connected to the valve plate;

the preset work mode comprises any one of mode1, mode2 and mode3:

the mode 1: the motor rotates continuously, the valve plate rotates with the motor in a circular motion, and a circle of rotation is a motor working cycle;

the mode 2: the motor works intermittently; after the motor drives the valve plate to deflect by a first preset angle from a first initial position to a first preset direction, the motor stops working, and the valve plate moves in a direction opposite to the first preset direction under an action of the torsion spring; after the valve plate moves to the first initial position, the motor continues working and drives the valve plate to deflect by the first preset angle in the direction opposite to the first preset direction, then the motor stops working, and the valve plate moves to the first preset direction under the action of the torsion spring until returning to the first initial position, which is a motor working cycle;

the mode 3: the motor works intermittently; after the motor drives the valve plate to deflect by a second preset angle from a second initial position to a second preset direction, the motor stops working, and the valve plate swings back and forth in the second preset direction and a direction opposite thereto under the action of the torsion spring until finally stopping at the second initial position, which is a motor working cycle.

5. The mud pressure wave signal modulation apparatus according to claim 1, further comprising a data processing and storage circuit;

the main control circuit is further configured to, when receiving the downhole Measurement While Drilling data sent by the downhole communication circuit, and determining that the downhole Measurement While Drilling data does not need to be transmitted to the ground according to the preset program, store the downhole Measurement While Drilling data in the data processing and storage circuit, and fetch the downhole Measurement While Drilling data therefrom when the downhole Measurement While Drilling data needs to be sent to the ground.

6. The mud pressure wave signal modulation apparatus according to claim 1, wherein the main control circuit is further configured to receive downhole real-time monitoring data sent by the downhole communication circuit; and when receiving a ground instruction indicating to send the downhole real-time monitoring data to the ground, generate the control sequence based on the motor data provided by the motor drive control circuit, the angle information of the valve plate provided by the downhole communication circuit and the preset working mode, and send the control sequence to the motor drive control circuit so that the motor drive control circuit controls the motor to work in the preset working mode.

7. The mud pressure wave signal modulation apparatus according to claim 1, further comprising a power conversion circuit which comprises a first end connected to the main control circuit, and a second end connected to the motor drive control circuit;

the main control circuit is further configured to, when receiving the downhole Measurement While Drilling data sent by the downhole communication circuit and determining that the downhole Measurement While Drilling data needs to be transmitted to the ground according to the preset program, if the motor drive control circuit is not started, control the power conversion circuit to supply power for the motor drive control circuit; and if the downhole Measurement While Drilling data no longer needs to be transmitted to the ground, control the power conversion circuit to stop supplying power to the motor drive control circuit.

8. The mud pressure wave signal modulation apparatus according to claim 1, wherein the motor data comprises at least one selected from a group of position information, coil temperature, rotor speed and motor fault code.

9. The mud pressure wave signal modulation apparatus according to claim 1, wherein the main control circuit is further configured to, when receiving a ground instruction indicating to switch the working mode, generate the control sequence based on the motor data provided by the motor drive control circuit, the angle information of the valve plate provided by the downhole communication circuit and switched working mode, and send the control sequence to the motor drive control circuit so that the motor drive control circuit controls the motor to work in switched working mode.

10. A mud pressure wave signal modulation method, which is applied to a mud pressure wave signal modulation apparatus, wherein the mud pressure wave signal modulation apparatus comprises a motor, a valve plate, a main control circuit, a motor drive control circuit, and a downhole communication circuit;

wherein the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in the drilling fluid channel, and the drilling fluid channel, the main control circuit, the motor drive control circuit and the downhole communication circuit are disposed in a drill collar; and the main control circuit is configured to receive downhole Measurement While Drilling data sent by the downhole communication circuit, generate a control sequence based on motor data provided by the motor drive control circuit, angle information of the valve plate provided by the downhole communication circuit and a preset working mode, when determining that the downhole Measurement While Drilling data needs to be transmitted to ground according to a preset program, and send the control sequence to the motor drive control circuit so that the motor drive control circuit controls the motor to work in the preset working mode, wherein the mud pressure wave signal modulation method comprises:

receiving the downhole Measurement While Drilling data sent by the downhole communication circuit, generating the control sequence based on the motor data provided by the motor drive control circuit, the angle information of the valve plate provided by the downhole communication circuit and the preset working mode, when determining that the downhole Measurement While Drilling data needs to be transmitted to the ground according to the preset program; and sending the control sequence to the motor drive control circuit, so that the motor drive control circuit controls the motor to work in the preset working mode.

11. The mud pressure wave signal modulation method according to claim 10, wherein the mud pressure wave signal modulation apparatus further comprises: a motor torque output shaft provided with a torsion spring, and the torsion spring comprises a first end connected to the motor torque output shaft and a second end connected to the valve plate;

the preset work mode comprises any one of mode1, mode2 and mode3:

the mode 1: the motor rotates continuously, the valve plate rotates with the motor in a circular motion, and a circle of rotation is a motor working cycle;

the mode 2: the motor works intermittently; after the motor drives the valve plate to deflect by a first preset angle from a first initial position to a first preset direction, the motor stops working, and the valve plate moves in a direction opposite to the first preset direction under an action of the torsion spring; after the valve plate moves to the first initial position, the motor continues working and drives the valve plate to deflect by the first preset angle in the direction opposite to the first preset direction, then the motor stops working, and the valve plate moves to the first preset direction under the action of the torsion spring until returning to the first initial position, which is a motor working cycle;

the mode 3: the motor works intermittently; after the motor drives the valve plate to deflect by a second preset angle from a second initial position to a second preset direction, the motor stops working, and the valve plate swings back and forth in the second preset direction and a direction opposite thereto under the action of the torsion spring until finally stopping at the second initial position, which is a motor working cycle.

12. The mud pressure wave signal modulation method according to claim 10, further comprising:

storing the downhole Measurement While Drilling data in a data processing and storage circuit, when receiving the downhole Measurement While Drilling data sent by the downhole communication circuit, and determining that the downhole Measurement While Drilling data does not need to be transmitted to the ground according to the preset program, and fetching the downhole Measurement While Drilling data therefrom when the downhole Measurement While Drilling data needs to be sent to the ground.

13. The mud pressure wave signal modulation method according to claim 10, further comprising: receiving downhole real-time monitoring data sent by the downhole communication circuit; and when receiving a ground instruction indicating to send the downhole real-time monitoring data to the ground, generating the control sequence based on the motor data provided by the motor drive control circuit, the angle information of the valve plate provided by the downhole communication circuit and the preset working mode, and sending the control sequence to the motor drive control circuit so that the motor drive control circuit controls the motor to work in the preset working mode.

14. The mud pressure wave signal modulation method according to claim 10, further comprising: when receiving the downhole Measurement While Drilling data sent by the downhole communication circuit and determining that the downhole Measurement While Drilling data needs to be transmitted to the ground according to the preset program, if the motor drive control circuit is not started, controlling a power conversion circuit to supply power for the motor drive control circuit; and if the downhole Measurement While Drilling data no longer needs to be transmitted to the ground, controlling the power conversion circuit to stop supplying power to the motor drive control circuit.

15. The mud pressure wave signal modulation method according to claim 10, wherein the motor data comprises at least one selected from a group of position information, coil temperature, rotor speed and motor fault code.

16. The mud pressure wave signal modulation method according to claim 10, further comprising when receiving a ground instruction indicating to switch the working mode, generating the control sequence based on the motor data provided by the motor drive control circuit, the angle information of the valve plate provided by the downhole communication circuit and switched working mode, and sending the control sequence to the motor drive control circuit so that the motor drive control circuit controls the motor to work in switched working mode.

17. A computer device, comprising a memory, a processor and a computer program stored in the memory and runnable on the processor, wherein when executing the computer program, the processor implements a mud pressure wave signal modulation method, which is applied to a mud pressure wave signal modulation apparatus, wherein the mud pressure wave signal modulation apparatus comprises a motor, a valve plate, the main control circuit, a motor drive control circuit, and a downhole communication circuit;

wherein the valve plate is driven by the motor to be rotated around an axial direction perpendicular to a flow direction of drilling fluid, and a cross-section for controlling a size of an actual flow channel of the drilling fluid in a drilling fluid channel is formed through the rotation of the valve plate; the motor and the valve plate are disposed in the drilling fluid channel, and the drilling fluid channel, the main control circuit, the motor drive control circuit and the downhole communication circuit are disposed in a drill collar; and the main control circuit is configured to receive downhole Measurement While Drilling data sent by the downhole communication circuit, generate a control sequence based on motor data provided by the motor drive control circuit, angle information of the valve plate provided by the downhole communication circuit and a preset working mode, when determining that the downhole Measurement While Drilling data needs to be transmitted to ground according to a preset program, and send the control sequence to the motor drive control circuit so that the motor drive control circuit controls the motor to work in the preset working mode, wherein the mud pressure wave signal modulation method comprises:

receiving the downhole Measurement While Drilling data sent by the downhole communication circuit, generating the control sequence based on the motor data provided by the motor drive control circuit, the angle information of the valve plate provided by the downhole communication circuit and the preset working mode, when determining that the downhole Measurement While Drilling data needs to be transmitted to the ground according to the preset program; and sending the control sequence to the motor drive control circuit, so that the motor drive control circuit controls the motor to work in the preset working mode.

* * * * *